United States Patent [19]

Eichengerger et al.

[11] Patent Number: 5,065,477

[45] Date of Patent: Nov. 19, 1991

[54] CALENDAR ROLLERS WITH ROUNDED TEETH FOR CRIMPING SLIVER AND INCREASING COHENSION LENGTH

[75] Inventors: Hansulrich Eichengerger; Heinz Clement, both of Winterthur, Switzerland

[73] Assignee: Rieter Machine Works, Ltd., Winterthur, Switzerland

[21] Appl. No.: 410,312

[22] Filed: Sep. 20, 1989

[30] Foreign Application Priority Data

Sep. 23, 1988 [CH] Switzerland ..... 03540/88

[51] Int. Cl.[5] ..... D01G 27/00

[52] U.S. Cl. ..... 19/150; 19/157; 19/159 R

[58] Field of Search ..... 19/97.5, 150, 152, 153, 19/157, 159 R, 115 A, 258

[56] References Cited

U.S. PATENT DOCUMENTS

| | | | |
|---|---|---|---|
| 2,316,824 | 4/1943 | Tobias | 19/150 |
| 2,685,711 | 8/1954 | Hinton | 19/157 |
| 2,878,527 | 3/1959 | Whitehurst | 19/159 R |
| 3,310,847 | 3/1967 | Aurich | 19/258 |
| 3,328,851 | 7/1967 | Whitehurst | 19/157 |

FOREIGN PATENT DOCUMENTS

| | | | |
|---|---|---|---|
| 2609615 | 9/1976 | Fed. Rep. of Germany . | |
| 3319514 | 12/1984 | Fed. Rep. of Germany . | |
| 2601661 | 6/1986 | France . | |
| 0000611 | of 1893 | United Kingdom | 19/115 A |
| 0017882 | of 1894 | United Kingdom | 19/115 A |
| 0004351 | of 1898 | United Kingdom | 19/115 A |
| 893512 | 10/1982 | United Kingdom . | |

OTHER PUBLICATIONS

Saco-Lowell, "Versamatic-High Speed, Drawing Frame etc. . . . "1972, all pages.

*Primary Examiner*—Werner H. Schroeder
*Assistant Examiner*—Ismael Izaguirre
*Attorney, Agent, or Firm*—Kenyon & Kenyon

[57] ABSTRACT

The device for increasing the cohesion length of the slivers is embodied by a pair of calendar rollers. Each calendar roller has a plurality of transversely disposed protuberances of rounded shape for interengaging in spaced relation with each other in order to slightly crimp a sliver passing through the gap between the rollers. The protuberances are adapted to one another in gear-like manner.

13 Claims, 2 Drawing Sheets

CALENDAR ROLLERS WITH ROUNDED TEETH FOR CRIMPING SLIVER AND INCREASING COHENSION LENGTH

FIELD OF THE INVENTION

This invention relates to a device for increasing the cohesion length of sliver, more particularly textile slivers.

BACKGROUND OF THE INVENTION

As is known, in spinning processes, a sliver is an intermediate product which appears for the first time after a card. This sliver is generally effective as a feed material or for further processing in subsequent spinning machinery. In order to prepare the sliver for a spinning machine which produces yarn, the discrete sliver fibers must be aligned lengthwise and parallel to one another. Usually, this is achieved by giving the sliver one or more drafting treatments or by combing out of the sliver on a comber followed by drafting.

The cohesion length of the resulting sliver is smaller in proportion as the fibers are aligned more parallel to one another since the cohesion length depends upon the coefficient of friction between the discrete fibers. However, the tendency for a sliver to tear, particularly on a relatively long feed path to a subsequent machine, increases in proportion as the fibers are aligned more parallel to one another. This is disadvantageous for subsequent processing. For example, yarn count errors may arise at restarting and the machine may have to be stopped.

German OS 3,610,212 discloses a construction wherein a number of pairs of pressing rollers are disposed after a drawframe with the aim of providing additional compression of the sliver. The purpose of this step is to increase the quantity of sliver which can be deposited in a can without the sliver in the can experiencing pressure. This pressing-together of the fibers briefly increases the friction between them and, therefore, the cohesion length. However, upon release of the pressure on the sliver, the cohesion length returns to a value little higher than before the pressing step.

German OS 3,319,514 discloses a pair of toothed rollers for conveying a sliver. Tooth height is relatively large so that the sliver can escape. Also, the teeth of the two rollers must be accurately aligned relatively to another if the fibers are not to be damaged.

Calendaring mechanisms have also been known from U.S. Pat. No. 3,328,851 which employ a pair of fluted rollers and means including a tension spring for resiliently maintaining a desired nip-spacing between the rollers during normal operation while permitting enlargement of such spacing in response to the occurrence of a lap-up condition or other increase in the thickness of the strand material within the mechanism at any given point in time.

Other types of conveying arrangements have also been known wherein a sliver is passed between a pair of fluted rollers such as described in German OS 3319514 and OS 2609615. Other types of arrangements are also from French Patent No. 2,601,661 for biasing a pair of smooth calendar rollers towards each other for compressing a sliver.

Accordingly, it is an object of the invention to provide a relatively simple device for increasing the cohesion length of sliver.

It is another object of the invention to provide a relatively simple structure for imparting increased cohesion length to a sliver for conveyance to subsequent processing stages.

It is another object of the invention to be able to increase the cohesion length of a sliver without damaging the fibers of the sliver and without imparting any detrimental characteristic to the sliver for subsequent processing.

SUMMARY OF THE INVENTION

Briefly, the invention provides a device for increasing the cohesion length of sliver which is comprised of a pair of parallel calendar rollers disposed in spaced relation to define a gap therebetween. In accordance with the invention, each roller has a plurality of transversely disposed protuberances for interengaging in spaced relation with the protuberances of the other roller in order to slightly crimp a sliver passing through the gap between the rollers. In addition, means are provided for spring biasing at least one of the rollers toward the other roller.

The protuberances are constructed in a toothed-like manner and, to ensure careful treatment of the sliver, the tooth-like protuberances have rounded edges. Advantageously, the tooth flank of each protuberance has a flat rise. This feature leads more particularly to the elimination of deposits of dirt in the recesses between the protuberances and to careful treatment of the discrete fibers.

A recess of 0.5 mm between the protuberances has proved advantageous. This value ensures adequate crimping of the fibers without detriment to the parallel alignment thereof.

These and other objects and advantages of the invention will become more apparent from the following detailed description taken in conjunction with the accompanying drawings wherein:

DESCRIPTION OF THE PREFERRED EMBODIMENT

Figure 1:
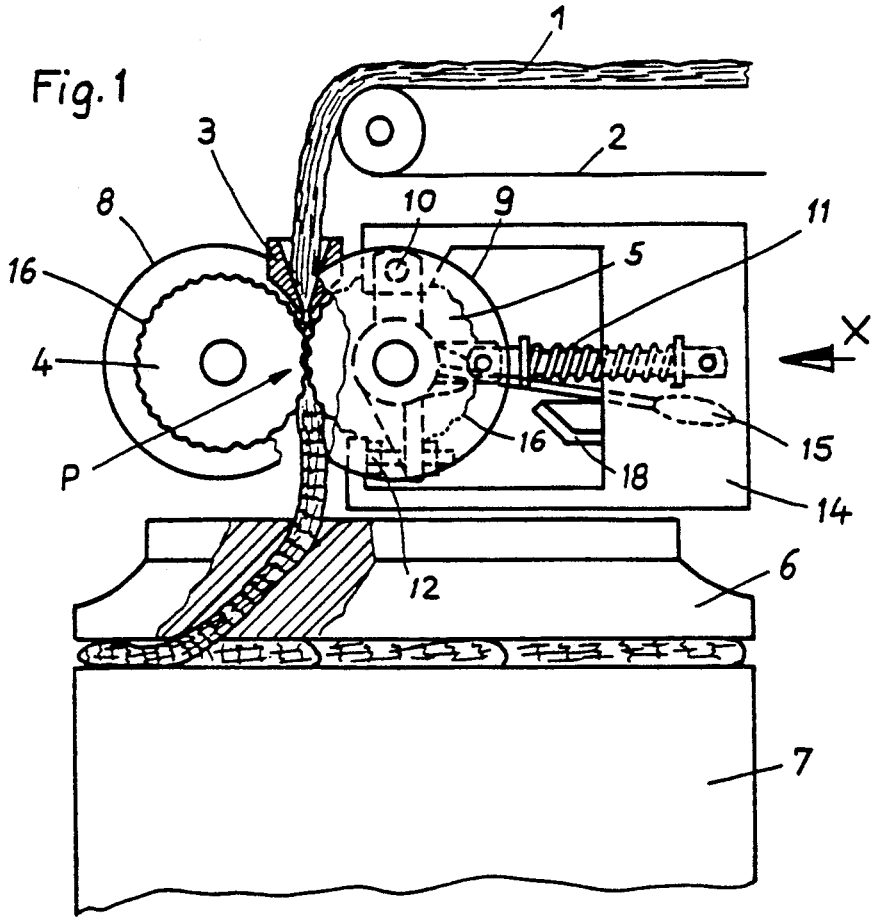
FIG. 1 diagrammatically illustrates a side elevational view of a device in accordance with the invention.

Referring to FIG. 1, the textile machine is constructed to receive a sliver 1 which is conveyed via a conveyor belt 2 to a condenser funnel 3. The sliver 1 which issues from the condenser funnel 3 passes to a device for increasing the cohesion length of the sliver, that is, to a pair of parallel calendar rollers 4, 5 disposed in spaced relation to define a gap therebetween. Thereafter, the sliver 1 is deposited by way of a rotating coiler tube wheel 6 into a sliver can 7.

As indicated, each of the calendar rollers 4, 5 has a lateral guide flange 8, 9 which extends beyond the diameter of the roller to provide lateral guidance of the sliver 1 which is gripped between the rollers 4, 5.

In addition, a means is provided for spring biasing at least the roller 5 toward the other roller 4. To this end, the roller 5 is mounted on a pivot shaft 10 (see FIG. 2) so as to swing towards and away from the roller 4. The means for biasing the roller 5 includes a compression spring 11 which is articulated to a stationary machine frame 14 at one end and which is secured at the opposite end to the roller 5. As illustrated in FIG. 1, the axis of the spring 11 is normally disposed in the plane of the axes of the rollers 4, 5.

Figure 2:
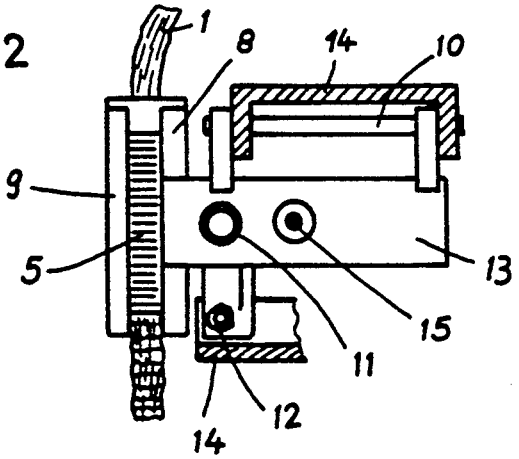
FIG. 2 illustrates a side view taken in the direction indicated by the arrow X in FIG. 1.

As indicated in FIG. 2, the roller 5 is mounted on a pivot tube 13 which is in turn secured by brackets to the pivot shaft 13. In addition, a bracket depends from the pivot tube 13 and carries an adjustable abutment 12 in the form of a threaded screw which abuts against a fixed part of the frame 14. The abutment 12 can be adjusted so that the gap between the rollers 4, 5 can be adjusted so that even when no sliver is passing through, there is always a small gap between the pressing surfaces of the rollers 4, 5. This particularly enables manufacturing tolerances to be compensated.

Referring to FIGS. 1 and 2, a lever 15 is secured to the tube 13 to enable the roller 5 to be pivoted out of the way, for example when a new sliver 1 is to be threaded in. When the lever 15 is raised, the spring 11 articulated to the machine frame 14 compresses until reaching a dead center position of the direction of force through the pivot 10. Upon further pivoting, the spring 11 begins to elongate. At the same time, the abutment 12 abuts against a web 14 of the frame 14 so that the roller 5 takes up a fixed pivoted-out position. The roller 5 is pivoted in a reverse sequence of operations.

Figure 3:
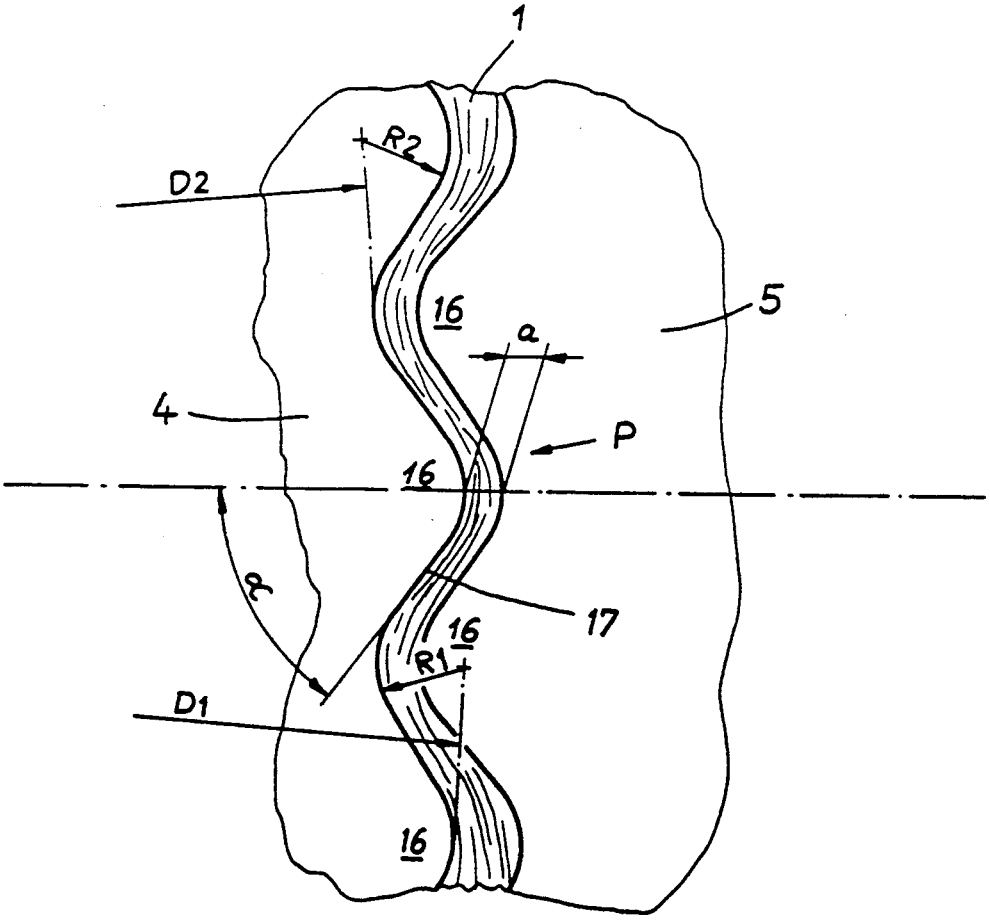
FIG. 3 illustrates an enlarged partial view of the calendar rollers of the device of FIG. 1 in accordance with the invention.

Referring to FIG. 3, each roller 4, 5 has a plurality of transversely disposed tooth-like protuberances thereon for interengaging in spaced relation with the protuberances 16 of the other roller in order to slightly crimp a sliver 1 passing through the gap therebetween. As indicated, the protuberances 16 are the same on both rollers 4, 5 and therefore mesh with one another in the fashion of spur gearing.

As previously stated, the abutment 12 is so adjusted that the gap a (FIG. 3) is always more than zero. The aim of this is to prevent damage or wear of the rollers 4, 5.

As will be apparent more particularly from the enlarged view of FIG. 3, the protuberances 16 are rounded with radii R1 and R2 at the tip diameter D1 and root diameter D2. Each flank 17 of a protuberance 16 extends at a relatively flat inclination angle $\alpha$ relative to a radius passing through a center of the protuberance which is greater than 45°. This ensures very careful treatment of the sliver 1 and obviates damage to the discrete fibers during pressing.

As illustrated in FIG. 3, each protuberance 16 has a crest of convex rounded shape of a radius R2 equal to the height of a protuberance. In addition, each roller has a recess of concave rounded shape between each pair of protuberances on a radius R1 equal to the height of a protuberance.

The guide flange 9 has been omitted from FIG. 3 for the sake of clarity.

The roller 4 is non-displaceably mounted on the frame 14 and is driven by a drive (not shown). The roller 5 is so mounted in the tube 13 as to be freely rotatable and is rotated by frictional engagement with the driven roller 4. The device operates as follows:

The sliver 1 supplied on the belt 2 passes through the funnel 3 into a pressing station P between the rollers 4, 5 (see FIG. 3).

The sliver 1, i.e. the fibers thereof are slightly crimped in the station P, the alignment being altered from a dead parallel alignment to a wavy or undulating alignment. This helps to increase considerably the cohesion length of the sliver 1, the variation not leading to disadvantages in subsequent processing machines The device according to the invention is suitable particularly for use after a combing process, the sliver having very reduced cohesion lengths after combing-out, piecing and drafting.

This increased cohesion length greatly reduces the risk of sliver breakage in subsequent machines and may facilitate conveyance by a belt over a relatively long feed path or indirect feeding to a subsequent processing machine without interim delivery into a can.

What is claimed is:

1. A device for increasing the cohesion length of sliver, said device comprising a pair of parallel calendar rollers disposed in spaced relation to a gap therebetween, each said roller having a plurality of transversely disposed protuberances thereon for interengaging in spaced relation with said protuberances of the other of said rollers to slightly crimp a sliver passing through said gap to increase the cohesion of length of the sliver; and means for spring biasing at least one of said rollers towards the other of said rollers, each said protuberance being of tooth-like cross-section with rounded edges and a pair of flanks, each flank defining an angle with a radius of said respective roller passing through a center of said protuberance of greater than 45°.

2. A device as set forth in claim 1 wherein each protuberance has a height of between 0.3 and 0.8 millimeters.

3. A device as set forth in claim 1 wherein each protuberance has a height of 0.5 millimeters.

4. A device as set forth in claim 1 wherein each protuberance has a crest of a convex rounded shape of a radius equal to the height of said protuberance and each roller has a concave rounded shape between each pair of protuberances of a radius equal to said height.

5. A device as set forth in claim 1 wherein each roller has a radially projecting lateral guide flange on one side, said flanges defining a transverse passage for guiding of the sliver therebetween into said gap.

6. In a textile machine, the combination comprising a condensor funnel for receiving and passing a sliver therethrough;

a pair of parallel calendar rollers downstream of said funnel to define a gap therebetween for receiving sliver from said funnel, each said roller having a plurality of transversely disposed protuberances thereon for interengaging in spaced relation with said protuberance of the other of said rollers to slightly crimp a sliver passing through said gap to increase the cohesion length of the sliver, each protuberance having a pair of flanks, each flank defining an angle with a radius of said respective roller passing through a center of said protuberance of greater than 45°; and means for spring biasing at least one of said rollers towards the other of said rollers.

7. The combination as set forth in claim 6 wherein each protuberance is of tooth-like cross-section with rounded edges.

8. The combination as set forth in claim 6 wherein each protuberance has a height of between 0.3 and 0.8 millimeters.

9. The combination as set forth in claim 8 wherein each protuberance has a crest of a convex rounded shape of a radius equal to the height of said protuberance

10. The combination as set forth in claim 6 wherein each roller has a radially projecting lateral guide flange on one side, said flanges defining a transverse passage for guiding of the sliver therebetween into said gap.

11. A device for increasing the cohesion length of sliver, said device comprising a pair of parallel calendar rollers disposed in spaced relation to a gap therebetween, each said roller having a plurality of transversely disposed protuberances thereon for interengaging in spaced relation with said protuberances of the other of said rollers to slightly crimp a sliver passing through said gap to increase the cohesion of length of the sliver, each said protuberance having a height of between 0.3 and 0.8 millimeters; and means for spring biasing at least one of said rollers towards the other of said rollers.

12. A device for increasing the cohesion length of sliver, said device comprising a pair of parallel calendar rollers disposed in spaced relation to a gap therebetween, each said roller having a radially projecting lateral guide flange on one side, said flanges defining a transverse passage for guiding of the sliver therebetween into said gap and each roller having a plurality of transversely disposed protuberances thereon for interengaging in spaced relation with said protuberances of the other of said rollers to slightly crimp a sliver passing through said gap to increase the cohesion of length of the sliver; and means for spring biasing at least one of said rollers towards the other of said rollers.

13. In a textile machine, the combination comprising a condensor funnel for receiving and passing a sliver therethrough;

a pair of parallel calendar rollers downstream of said funnel to define a gap therebetween for receiving sliver from said funnel, each said roller having a radially projecting lateral guide flange on one side, said flanges defining a transverse passage for guiding of the sliver therebetween into said gap and each roller having a plurality of transversely disposed protuberances thereon for interengaging in spaced relation with said protuberances of the other of said rollers to slightly crimp a sliver passing through said gap to increase the cohesion of length of the sliver; and means for spring biasing at least one of said rollers towards the other of said rollers.

* * * * *

UNITED STATES PATENT AND TRADEMARK OFFICE

CERTIFICATE OF CORRECTION

PATENT NO. : 5,065,477

DATED : November 19, 1991

INVENTOR(S) : HANSULRICH EICHENGERGER; HEINZ CLEMENT

It is certified that error appears in the above-identified patent and that said Letters Patent is hereby corrected as shown below:

Column 3, line 8 change "shaft 13" to -shaft 10-
Line 29 after "protuberances" insert -16-
Column 4, line 16 after "relation to" insert -define-
Line 52 change "protuberance" to -protuberances- Signed and Sealed this Twenty-first Day of September, 1993

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,065,477

DATED : Nov. 19, 1991

INVENTOR(S) : HANSULRICH EICHENGERGER, et al

It is certified that error appears in the above-identified patent and that said Letters Patent is hereby corrected as shown below:

Column 3, line 8 change "shaft 13" to -shaft 10-
Line 29 after "protuberances" insert -16-

Column 4, line 16 after "relation to" insert -define-
Line 21 cancel "of" (first occurrence)
Line 52 change "protuberance" to -protuberances- Column 6, line 22 cancel "of"

Signed and Sealed this

Second Day of November, 1993

Bruce Lehman

BRUCE LEHMAN

*Commissioner of Patents and Trademarks*

*Attest:*

*Attesting Officer*